US009384608B2

(12) United States Patent
Strulovitch et al.

(10) Patent No.: US 9,384,608 B2
(45) Date of Patent: Jul. 5, 2016

(54) DUAL LEVEL HUMAN IDENTIFICATION AND LOCATION SYSTEM

(71) Applicants: Tsahi Z. Strulovitch, Fort Lauderdale, FL (US); Richard L. Copeland, Lake Worth, FL (US); Melwyn F. Sequeira, Plantation, FL (US)

(72) Inventors: Tsahi Z. Strulovitch, Fort Lauderdale, FL (US); Richard L. Copeland, Lake Worth, FL (US); Melwyn F. Sequeira, Plantation, FL (US)

(73) Assignee: Tyco Fire & Security GMBH, Neuhausen am Rheinfall (CH)

( * ) Notice: Subject to any disclaimer, the term of this patent is extended or adjusted under 35 U.S.C. 154(b) by 0 days.

(21) Appl. No.: 14/956,902

(22) Filed: Dec. 2, 2015

(65) Prior Publication Data

US 2016/0163137 A1 Jun. 9, 2016

Related U.S. Application Data

(63) Continuation of application No. 14/558,796, filed on Dec. 3, 2014.

(60) Provisional application No. 62/205,953, filed on Aug. 17, 2015.

(51) Int. Cl.
*G07C 9/00* (2006.01)

(52) U.S. Cl.
CPC ..... *G07C 9/00111* (2013.01); *G07C 9/00031* (2013.01); *G07C 9/00309* (2013.01); *G07C 2009/00769* (2013.01)

(58) Field of Classification Search
CPC ..... G05B 1/01; G07C 9/00; G07C 9/00031
USPC ..... 340/5.54, 5.61–5.65, 5.61–5.65
See application file for complete search history.

(56) References Cited

U.S. PATENT DOCUMENTS 5,532,705 A 7/1996 Hama
5,763,868 A 6/1998 Kubota et al.

(Continued)

FOREIGN PATENT DOCUMENTS

CN 203825788 9/2014
EP 1213673 A2 6/2002

(Continued)

OTHER PUBLICATIONS

Rais, N.H.M., et al., "A Review of Wearable Antenna," Antennas & Propagation Conference, 2009, LAPC 2009, Loughborough, Published IEEE; 978-1-4244-2720-8; DOI: 10.1109/LAPC.2009.5352373.

(Continued)

*Primary Examiner* — Allen T Cao
(74) *Attorney, Agent, or Firm* — Fox Rothschild LLP; Robert J. Sacco; Carol E. Thorstad-Forsyth

(57) ABSTRACT

Systems and methods for controlling access to a Restricted Area ("RA"). The methods involve: determining whether a person desires to enter RA; checking whether the person is authorized to enter RA using a first unique identifier associated with a wearable access sensor being worn thereby; causing the person's Portable Communication Device ("PCD") to transmit a second unique identifier and location information useful in determining the PCD's location within a surrounding environment, when a determination is made that the person is authorized to enter RA; using the second unique identifier and location information to confirm that the person is currently located at an access point of RA; and causing actuation of a mechanical actuator to enable the person's entrance into RA when it is determined that the person desires to enter RA, the person is authorized to enter RA, and the person is currently located at the access point of RA.

20 Claims, 9 Drawing Sheets

(56) References Cited

U.S. PATENT DOCUMENTS

| | | | | |
|---|---|---|---|---|
| 5,947,369 | A * | 9/1999 | Frommer | G06K 19/06046 235/380 |
| 6,788,262 | B1 | 9/2004 | Adams et al. | |
| 6,888,502 | B2 | 5/2005 | Beigel et al. | |
| 6,950,098 | B2 * | 9/2005 | Brabander | G02F 1/13318 324/754.23 |
| 7,424,316 | B1 | 9/2008 | Boyle | |
| 7,450,077 | B2 | 11/2008 | Waterhouse et al. | |
| 7,629,934 | B2 | 12/2009 | Rhodes et al. | |
| 7,696,882 | B1 * | 4/2010 | Rahimi | G06Q 10/087 340/505 |
| 7,982,616 | B2 | 7/2011 | Banerjee et al. | |
| 8,267,325 | B2 | 9/2012 | Phaneuf | |
| 8,497,808 | B2 | 7/2013 | Wang | |
| 8,599,101 | B2 | 12/2013 | Christie et al. | |
| 8,646,695 | B2 | 2/2014 | Worrall et al. | |
| 8,674,810 | B2 | 3/2014 | Uysal et al. | |
| 8,917,214 | B2 | 12/2014 | Forster | |
| 9,076,273 | B2 | 7/2015 | Smith et al. | |
| 2002/0140558 | A1 | 10/2002 | Lian et al. | |
| 2004/0246103 | A1 * | 12/2004 | Zukowski | G06F 21/79 340/10.41 |
| 2005/0285740 | A1 * | 12/2005 | Kubach | G06Q 10/087 340/572.1 |
| 2006/0219778 | A1 * | 10/2006 | Komatsu | H04L 63/0853 235/382 |
| 2007/0182559 | A1 | 8/2007 | Lawrence et al. | |
| 2007/0294746 | A1 | 12/2007 | Sasakura et al. | |
| 2008/0055045 | A1 | 3/2008 | Swan et al. | |
| 2009/0121931 | A1 | 5/2009 | Katz | |
| 2009/0322513 | A1 * | 12/2009 | Hwang | A61B 5/02055 340/539.12 |
| 2010/0315244 | A1 * | 12/2010 | Tokhtuev | G06Q 10/00 340/603 |
| 2011/0022121 | A1 | 1/2011 | Meskins | |
| 2011/0148602 | A1 * | 6/2011 | Goh | G01S 5/0252 340/10.41 |
| 2011/0316700 | A1 * | 12/2011 | Kasahara | G08B 29/185 340/541 |
| 2012/0056719 | A1 | 3/2012 | Krishna et al. | |
| 2012/0234921 | A1 | 9/2012 | Tiedmann et al. | |
| 2012/0242501 | A1 * | 9/2012 | Tran | A61B 5/0024 340/870.02 |
| 2012/0286927 | A1 * | 11/2012 | Hagl | G07C 9/00309 340/5.61 |
| 2013/0027180 | A1 * | 1/2013 | Lakamraju | G07C 9/00087 340/5.53 |
| 2014/0077929 | A1 * | 3/2014 | Dumas | G07C 9/00571 340/5.61 |
| 2014/0085050 | A1 | 3/2014 | Luna | |
| 2014/0159959 | A1 | 6/2014 | Rhoads et al. | |
| 2014/0159975 | A1 | 6/2014 | Apostolos et al. | |
| 2014/0226844 | A1 | 8/2014 | Kerselaers | |
| 2014/0240087 | A1 | 8/2014 | Liu et al. | |
| 2014/0240088 | A1 | 8/2014 | Robinette et al. | |
| 2014/0354494 | A1 | 12/2014 | Katz | |
| 2015/0041614 | A1 | 2/2015 | Tran et al. | |
| 2015/0054696 | A1 | 2/2015 | Werner et al. | |
| 2015/0149310 | A1 * | 5/2015 | He | G06Q 20/322 705/21 |
| 2015/0221147 | A1 * | 8/2015 | Daniel-Wayman | G07C 9/00039 340/5.54 |
| 2015/0264431 | A1 * | 9/2015 | Cheng | H04N 21/44218 725/10 |
| 2015/0339870 | A1 * | 11/2015 | Cojocaru | G07C 9/00039 340/5.53 |
| 2015/0379791 | A1 * | 12/2015 | Russell | G07C 9/00031 340/5.61 |
| 2016/0007315 | A1 * | 1/2016 | Lundgreen | G01S 3/46 455/67.11 |

FOREIGN PATENT DOCUMENTS

| | | | |
|---|---|---|---|
| EP | 1283474 | A1 | 2/2003 |
| EP | 2068535 | A1 | 6/2009 |
| EP | 2330698 | B1 | 6/2011 |
| EP | 2495621 | | 9/2012 |
| WO | 9941721 | A1 | 8/1999 |
| WO | 2008008101 | A2 | 1/2008 |
| WO | 2014/113882 | A1 | 7/2014 |
| WO | 2014/210000 | | 12/2014 |
| WO | 2015/023737 | A1 | 2/2015 |

OTHER PUBLICATIONS

Hall, P.S., et al., "Antennas and Propagation for Body Centric Communications," Proc. 'EUCAP 2006', Nice, France, Nov. 3-10, 2006 (ESA SP-626, Oct. 2006).

Conway, G.A., et al., "Antennas for Over-Body-Surface Communication at 2.45 GHz," IEEE Transactions on Antennas and Propagation, vol. 57, No. 4, Apr. 2009, 0018-926X, copyright 2009 IEEE.

Ito, K., et al., "Wearable Antennas for Body-Centric Wireless Communications," copyright IEEE 2010; 978-1-4244-6418-0/10.

Matthews, J.C.G., et al., "Body Wearable Antennas for UHF/VHF," 2008 Loughborough Antennas & Propagation Conference, 978-1-4244-1894-7/08, copyright 2008 IEEE.

* cited by examiner

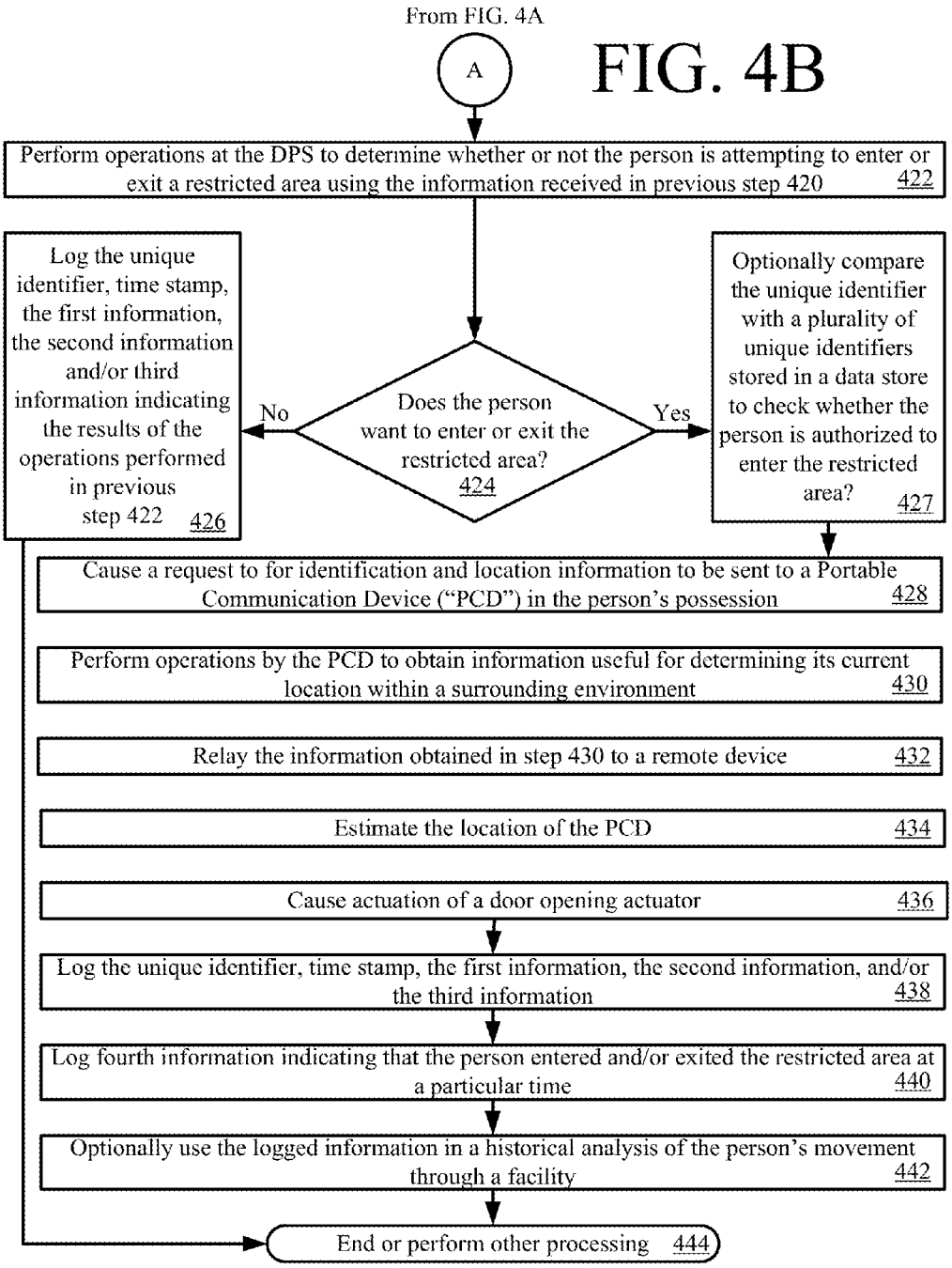
From FIG. 4A
A
FIG. 4B
Perform operations at the DPS to determine whether or not the person is attempting to enter or exit a restricted area using the information received in previous step 420 422
Log the unique identifier, time stamp, the first information, the second information and/or third information indicating the results of the operations performed in previous step 422 426
No
Does the person want to enter or exit the restricted area? 424
Yes
Optionally compare the unique identifier with a plurality of unique identifiers stored in a data store to check whether the person is authorized to enter the restricted area? 427
Cause a request to for identification and location information to be sent to a Portable Communication Device ("PCD") in the person's possession 428
Perform operations by the PCD to obtain information useful for determining its current location within a surrounding environment 430
Relay the information obtained in step 430 to a remote device 432
Estimate the location of the PCD 434
Cause actuation of a door opening actuator 436
Log the unique identifier, time stamp, the first information, the second information, and/or the third information 438
Log fourth information indicating that the person entered and/or exited the restricted area at a particular time 440
Optionally use the logged information in a historical analysis of the person's movement through a facility 442
End or perform other processing 444

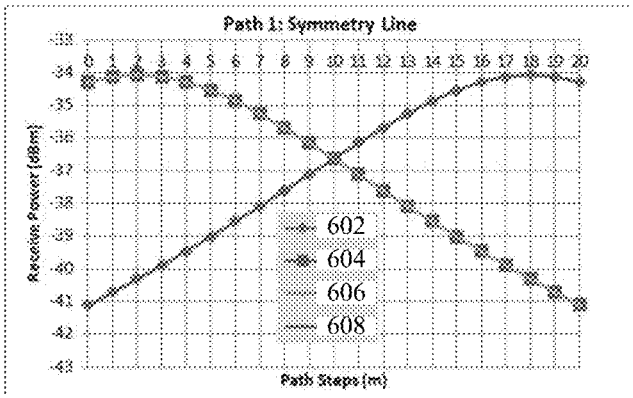
FIG. 7
FIG. 8
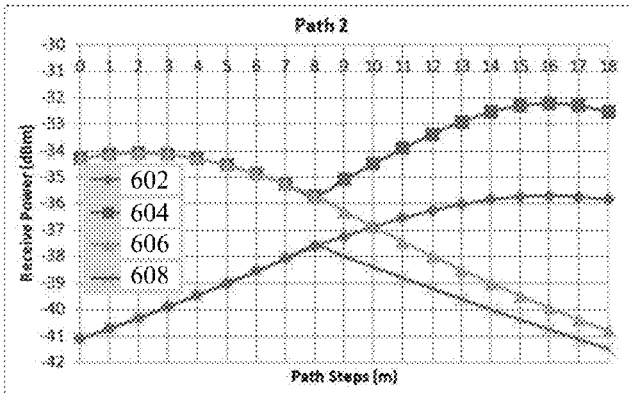
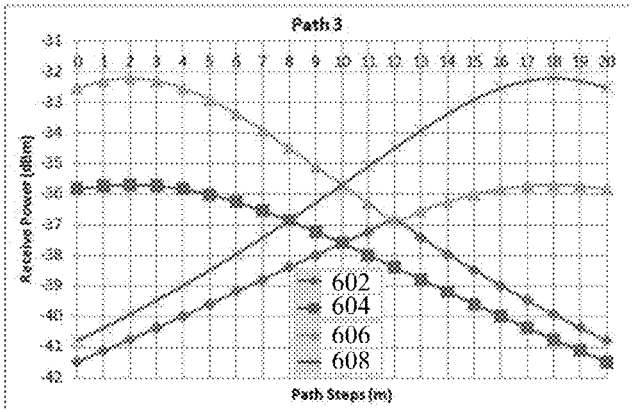
FIG. 9

DUAL LEVEL HUMAN IDENTIFICATION AND LOCATION SYSTEM

CROSS-REFERENCE TO RELATED APPLICATIONS

This application claims priority benefits of U.S. Provisional Patent Application No. 62/205,953 filed on Aug. 17, 2015 and U.S. patent application Ser. No. 14/558,796 filed on Dec. 3, 2014, the contents of which are herein incorporated by reference.

BACKGROUND OF THE INVENTION

1. Statement of Technical Field

This document relates generally to Access Control Systems ("ACSs"). More particularly, the present document concerns dual level human identification and location systems.

2. Description of the Related Art

There are many ACSs known in the art. One such ACS comprises a plurality of Access Control Readers ("ACRs") mounted at exits and/or entries of restricted areas. For example, an ACR may be disposed adjacent to a doorway through which access to a restricted room is gained. A badge worn by a person is used to gain access to a restricted room via the ACR. In this regard, the badge comprises a Low Frequency ("LF") passive Radio Frequency Identification ("RFID") communication device disposed thereon or therein. The LF passive RFID communication device typically operates at a frequency of 125 kHz. The ACR is a near field device with a detection range of about 5 cm or less. Throughout a given time period, the ACS tracks which entries a given person passes through for purposes of entering a restricted area. However, the ACS does not track when the person leaves each visited restricted area within the given time period.

Another conventional ACS employs beacons and wireless communication devices (e.g., mobile phones) which communicate via Bluetooth technology. A personal identifier is stored on the wireless communication device, and communicated to the beacon when the person is in proximity thereto. In response to the reception of the personal identifier, the ACS would allow the person to have access to the restricted area.

SUMMARY OF THE INVENTION

The present disclosure relates to systems and methods for controlling access to a restricted area. The methods comprise determining, by an electronic circuit, whether a person desires to enter the restricted area. In some scenarios, this determination is made based on (a) Received Signal Strength Indicator ("RSSI") measurement data specifying a power present in a signal received from a Wearable Access Sensor ("WAS") worn by the person and/or (b) rate of change data specifying a rate of change of a charging voltage of an energy storage device used in an electromagnetic field energy harvesting circuit disposed within the WAS. After making such a determination, it is checked whether the person is authorized to enter the restricted area using a first unique identifier associated with the WAS.

When a determination is made that the person is authorized to enter the restricted area, the person's Portable Communication Device ("PCD") is caused to transmit a second unique identifier and location information useful in determining the PCD's location within a surrounding environment. In some scenarios, the location information is obtained by the PCD using an RSSI based technique. The RSSI technique comprises: performing operations by the PCD to survey an available networks' Media Access Control ("MAC") addresses within range thereof; and collecting RSSI levels for signals received from devices associated with the available networks' MAC addresses. The RSSI levels and known locations of the devices associated with the available networks' MAC addresses are used to confirm that the person is currently located at an access point of the restricted area.

The second unique identifier and location information is used to confirm that the person is currently located at an access point of the restricted area. A mechanical actuator is actuated to enable the person's entrance into the restricted area when it is determined that the person desires to enter the restricted area, the person is authorized to enter the restricted area, and/or the person is currently located at the access point of the restricted area.

In some scenarios, the methods further involve determining whether the PCD is within a certain radius from the access point of the restricted area. The mechanical actuator is caused to actuate when it is determined that the PCD is within a certain radius from the access point of the restricted area. Additionally or alternatively, the methods involve logging information indicating that the person entered the restriction area at a particular time, subsequent to causing actuation of the mechanical actuator.

DESCRIPTION OF THE DRAWINGS

Embodiments will be described with reference to the following drawing figures, in which like numerals represent like items throughout the figures, and in which:

FIGS. 4A-4B (collectively referred to as "FIG. 4") provide a flow diagram of another exemplary method for controlling access to a restricted area.

FIG. 7 is a graph showing received power from four antennas along a first path.

FIG. 8 is a graph showing received power from four antennas along a second path.

FIG. 9 is a graph showing received power from four antennas along a third path.

DETAILED DESCRIPTION OF THE INVENTION

Figure 1:
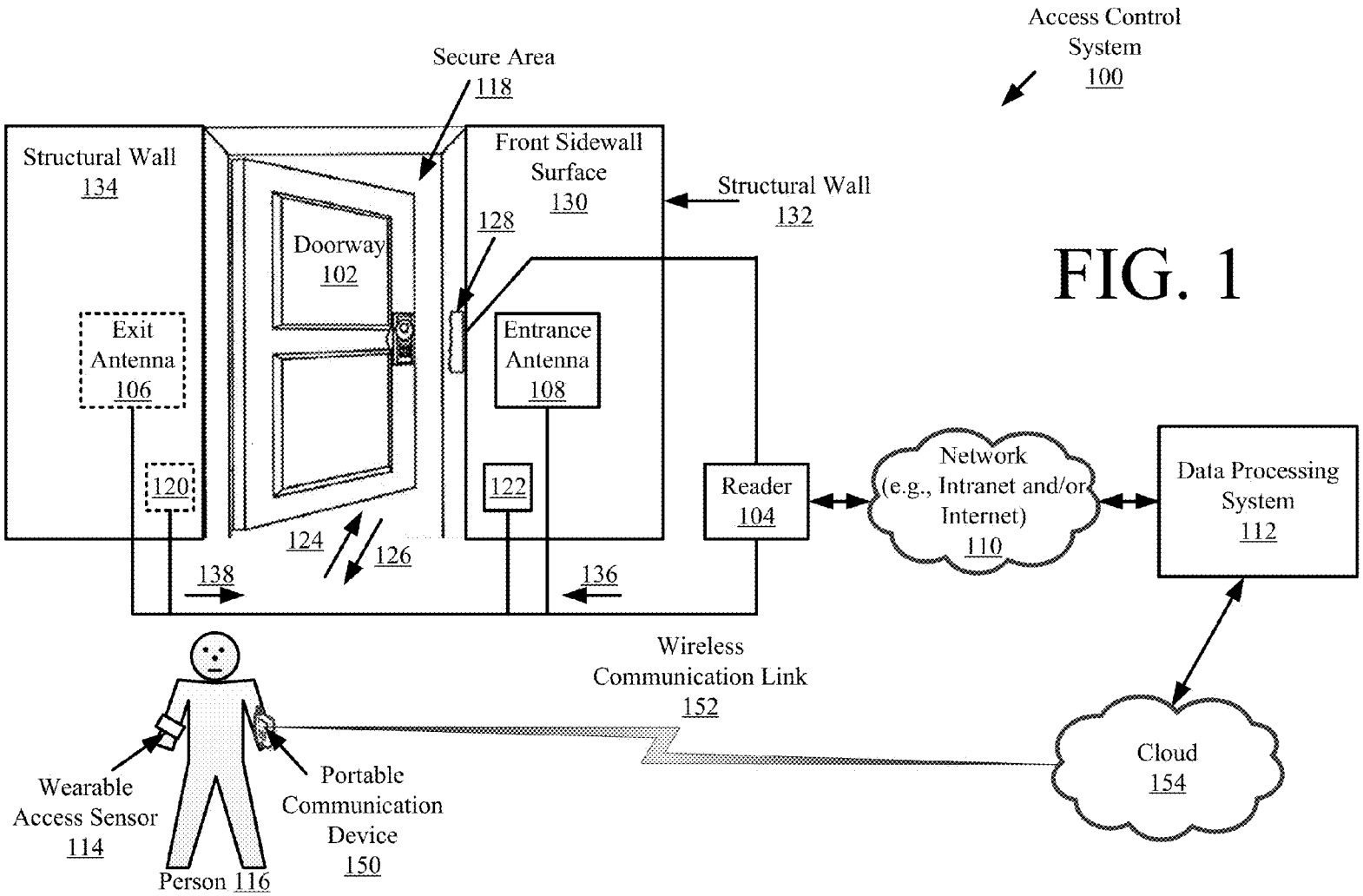
FIG. 1 is a perspective view of an exemplary ACS.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

A large and growing number of people own and carry smart phones with them throughout the workplace, school, or other environments where Wi-Fi network infrastructures already exists. The smart phone has an identity which is directly associated with the owner's name and can serve as a reliable credential for identification. The Wi-Fi network in a building consists of many routers. The routers have known addresses, as well as locations that are spatially distributed to allow adequate coverage throughout the building.

Software applications allow a smart phone to measure the received signal strength or RSSI from each router within reach of the smart phone. This information can then be sent to the cloud. At the cloud, the RSSI information and router spatial position information are used to compute the smart phone's position in the building. The smart phone's position is then reported directly to the building network. The software application can be turned on as soon as it picks up the building Wi-Fi upon entering the building. Thereafter, the software application runs an update on location based on predetermined time intervals. When the smart phone is not moving (e.g., determined based on phone motion sensor output information), the update is discontinued until motion resumes.

U.S. patent application Ser. No. 14/558,796 to Copeland et al. ("the '796 patent application", which is incorporated herein by reference) describes an access control system using a body wearable sensor and a reader. The reader uses either Received Signal Strength Indication ("RSSI") information from an Ultra High Frequency ("UHF") RFID sensor or a UHF energy harvesting sensor with transceiver radio communications and energy harvesting electronics. The UHF approach allows for longer range detection of the sensor with detection distances of typically 1-2 meters from the interrogation antenna.

While the '796 patent application is an improvement over existing access control, it is still a single credential security system. Using both the body WAS as described in the '796 patent application along with a PCD unique identifier (e.g., a MAC address of a cellular phone) and current location within a facility, a dual level identification and location system is achieved. Having two independent identification means has a much higher degree of security than any one method. Algorithms can be adjusted to weigh on the use of each signal by itself or in combination. For example, if someone does not enter an access point with a PCD but is wearing a WAS, there is a certain degree of security identification. With both the WAS and the PCD (e.g., a smart phone or a smartwatch), there is a dual and much higher degree of security.

This disclosure concerns systems and methods for implementing a second layer of security using personal\corporate PCDs to confirm peoples identities at monitored entry points in addition to the techniques described in the '796 patent application. In this regard, a PCD, a PCD application, and a remote database\service ("cloud") are implanted in each system. Each user of the system is required to: install the PCD application on his(her) PCD; and use his(her) personal/corporate credentials in order to register his(her) PCD within the system. From that point on, the PCD application stays passive in a sense that it does not communicate back to the cloud unless requested (e.g., for energy conservation purposes). Alternatively, the PCD periodically reports to the cloud for tracking and logging purposes.

During operation, the cloud sends a request for identification and location information to the PCD subsequent to or concurrent with the WAS based identification/authentication operations of the '796 patent application. In response to the request, the PCD obtains information specifying its current location within a secured area. This location information can be obtained using at least one of the following techniques: a Global Positioning System ("GPS") based technique; an RSSI based technique; and a beacon based technique. The RSSI based technique will be explained in detail below. However, the GPS and beacon based techniques are well known in the art, and therefore will not be described herein. Next, the PCD sends its unique identifier (e.g., a MAC address) and location information to the cloud. At the cloud, this information is used to confirm or verify that the user is actually located at a given exit/entry ($2^{nd}$ layer security).

Referring now to FIG. 1, there is provided an exemplary ACS 100 configured for controlling access to restricted areas. As shown in FIG. 1, ACS 100 is generally configured to manage the entrance and exit of people through at least one secure area 118. In this regard, each secure area is entered and exited via an access point, such as a doorway 102. Exit and entrance antennas 106, 108 are disposed on front and back surfaces of the same structural wall or different structural walls located adjacent to the access point 102. For example, the entrance antenna 108 is disposed on a front sidewall surface 130 of a structural wall 132 located adjacent to the doorway 102. In contrast, the exit antenna 106 is disposed on a back sidewall surface (not shown in FIG. 1) of a structural wall 134 located adjacent to the doorway 102. The antennas 106, 108 are also communicatively coupled to a reader 104.

The reader 104 is communicatively coupled to a Data Processing System ("DPS") 112 via a network 110 (e.g., an Intranet and/or an Internet).

A WAS 114 is assigned to each individual authorized for accessing restricted areas of a business entity. The WAS 114 comprises a wearable communications device that can be worn by the person 116 to which it is assigned. As shown in FIG. 1, WAS 114 comprises a wrist band with internal sensor circuitry (not shown in FIG. 1). The present invention is not limited in this regard. WAS 114 can include any other type of wearable item, such as a watch, necklace, hat or clip-on item which can be worn on a person or on a person's clothing at a location offset from the person's center axis. In all scenarios, the WAS 114 facilitates the entrance and exit of the authorized person through the secure area 118.

Figure 2:
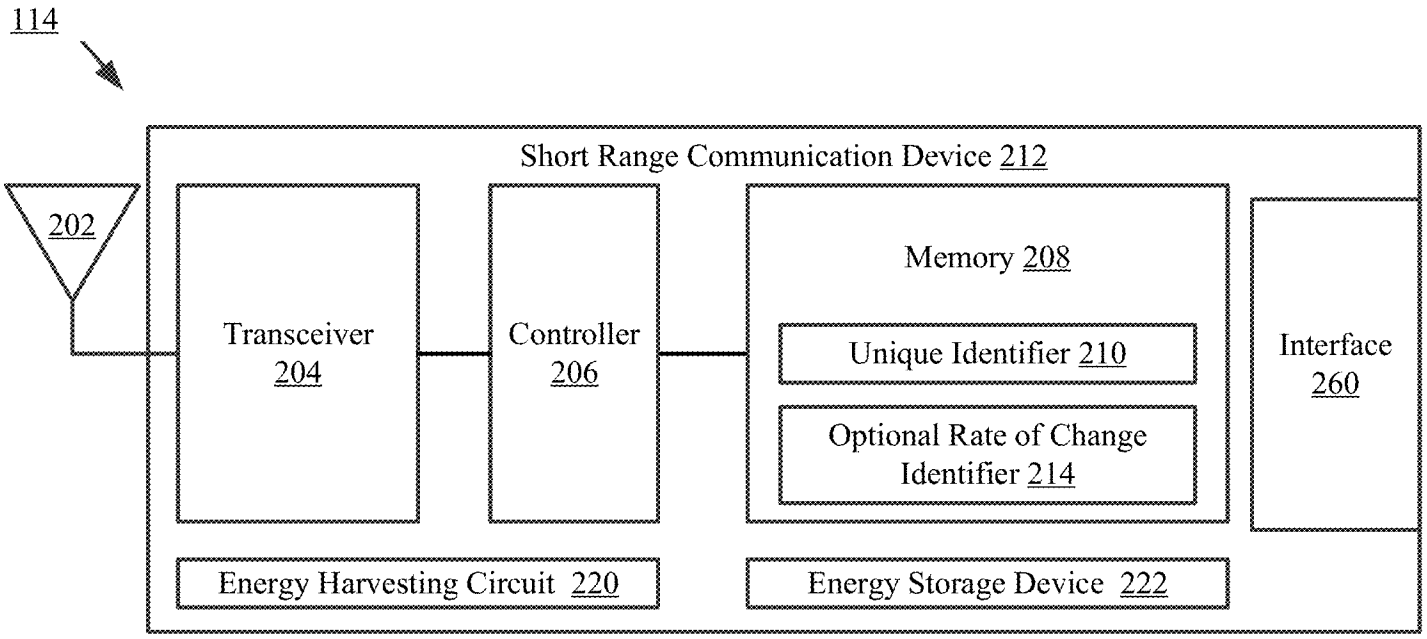
FIG. 2 is a block diagram of an exemplary architecture for the WAS of FIG. 1.

A schematic illustration of an exemplary architecture for the sensor circuitry of WAS 114 is provided FIG. 2. As shown in FIG. 2, the sensor circuitry comprises an energy harvesting circuit 220 for deriving energy from an external source to power other electronic components 204, 206, 208, 260 internal to WAS 114. The energy is collected from an electromagnetic field emitted within a surrounding environment from equipment disposed at an access point of a restricted area. The energy is stored in an energy storage device 222 (e.g., a capacitor) for later use in electronic components 204, 206, 208, 260.

Figure 5:
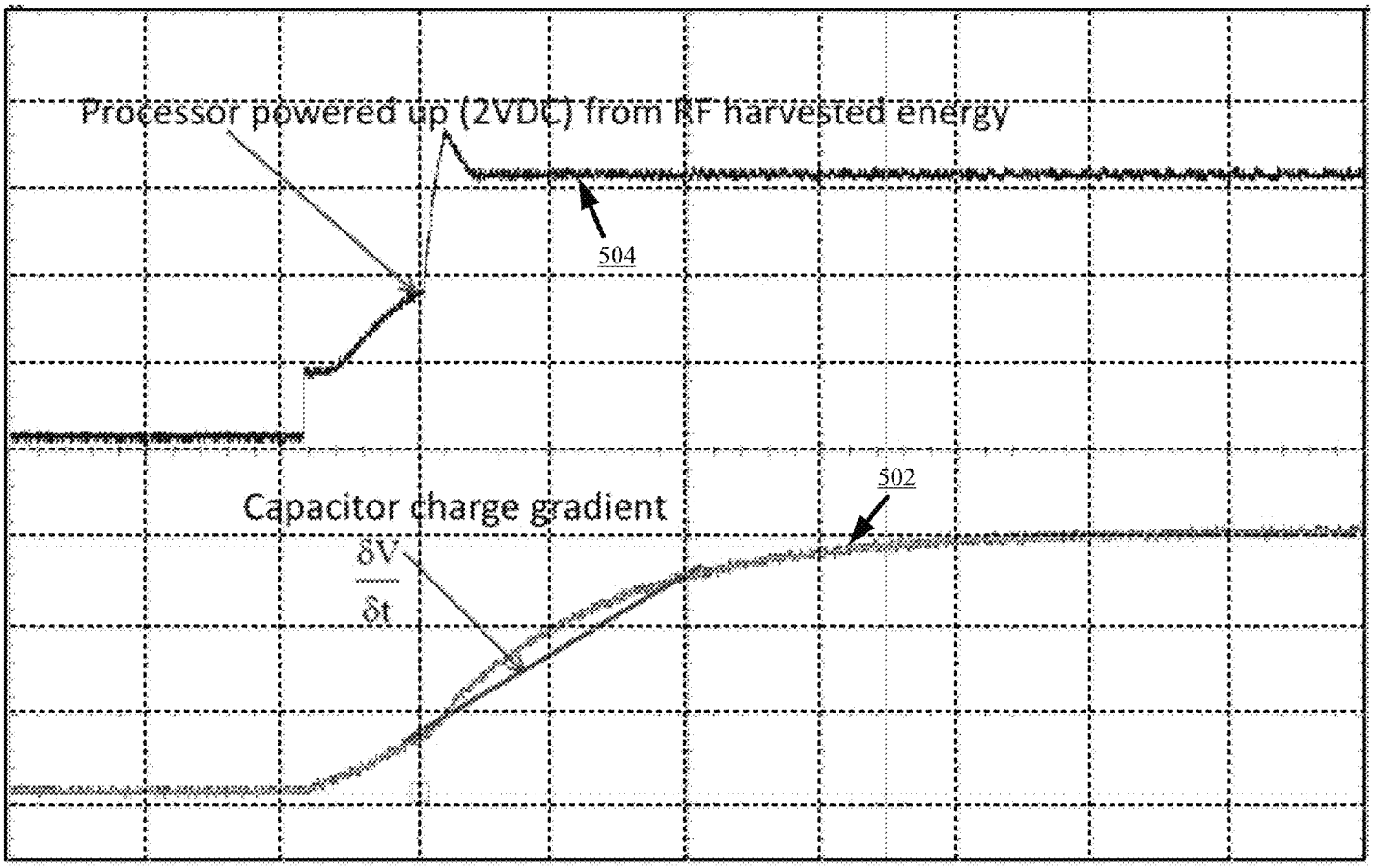
FIG. 5 is a graph illustrating the collection of energy by an energy harvesting device as it travels closer to an access point of a restricted area.

A graph 502 is provided in FIG. 5 that illustrates the collection of energy by the energy harvesting circuit 220 as the person travels closer to an access point of a restricted area. FIG. 5 also includes a graph 504 illustrating the supply of power to a processor of the WAS 114. When the processor is supplied power, the WAS 114 begins collecting data specifying the rate of energy storage by the energy storage device 222.

Referring again to FIG. 2, the antenna 202 of WAS 114 may comprise a directional antenna arranged to point away from the person's body when the WAS 114 is being worn thereby. The antenna 202 is coupled to a Short Range Communication ("SRC") device 212 implementing SRC technology. The SRC technology includes, but is not limited to, RFID technology which uses radio-frequency electromagnetic fields to identify persons and/or objects when they come close to the reader 104. Accordingly, the SRC device 212 facilitates communication of a unique identifier 210 to the reader 104 via SRC reply signals in response to interrogation signals sent from reader 104. The unique identifier 210 is then used by the reader 104 and/or DPS 112 to automatically identify the person 116 which is in proximity to the access point 102 and/or whether the person is authorized to access the restricted area.

At the access point 102, the reader 104 determines the directionality of the WAS 114 emitting the SRC reply signal. This determination is made based on RSSI measurements of the power present in the SRC reply signal received by an antenna 106 or 108 from the WAS 114. The RSSI measurements specify the signal strength of the SRC reply signal received at antenna 106 or antenna 108, and whether the signal strength is increasing or decreasing during a given period of time. If the signal strength of the SRC reply signal is increasing during the given period of time, then the WAS 114 is deemed to be traveling towards the respective antenna 106 or 108. In contrast, if the signal strength of the SRC reply signal is decreasing during the given period of time, then the WAS 114 is deemed to be traveling away from the respective antenna 106 or 108.

However, such determinations are not sufficient to detect whether the person is attempting to enter or exit the restricted area. Accordingly, additional motion sensors 120, 122 are employed herein. The motion sensors may be provided at the access point 102. A first motion sensor 122 is disposed on the front sidewall surface 130 of the structural wall 132 located adjacent to the access point 102. In contrast, a second motion sensor 120 is disposed on a back sidewall surface (not shown in FIG. 1) of the structural wall 134 located adjacent to the access point 102. The motion sensors 120, 122 are used to determine the direction and/or speed/velocity of travel of the person 116 in proximity to the access point 102. Information specifying the person's direction and/or speed/velocity of travel is provided from the motion sensors 120, 122 to the reader 104.

Notably, the present invention is not limited to the motion sensor configuration shown in FIG. 1. Additionally or alternatively, the motion sensors provided in PCDs (e.g., mobile phones or smart phones) can be used to detect the direction and/or velocity of the person's motion.

In turn, the reader 104 forwards the information received from the motion sensor(s) 120, 122 to the DPS 112 via network 110. Similarly, reader 104 communicates information to the DPS 112 indicating the directionality of the WAS 114 (i.e., whether the WAS 114 is traveling towards or away from the antenna 106 or 108). The DPS 112 may be located in the same facility as the reader 104 or in a different facility remote from the facility in which the reader 104 is disposed. As such, the network 110 may comprise an Intranet and/or the Internet. Additionally, each exit and/or entrance to a restricted area in each facility of a business entity may have access control sensory systems 104-108, 120, 122 disposed thereat so as to define a distributed network of access control sensor systems.

At the DPS 112, the information is used to determine whether or not the person is attempting to enter or exit the access point 102. For example, if the information indicates that the WAS 114 is traveling towards the entrance antenna 108 and the person is moving in direction 124, then a determination is made that the person desires to enter the restricted area via access point 102. In contrast, if the information indicates that the WAS 114 is traveling towards antenna 106 and the person is moving in direction 126, then a determination is made that the person desires to exit the restricted area via the access point 102. If the information indicates that the WAS 114 is traveling away from the antenna 108, then a determination is made that the person is not trying to enter the restricted area. Similarly, if the information indicates that the WAS 114 is traveling away from the antenna 106, then a determination is made that the person is not trying to exit the restricted area.

The DPS 112 may also analyze patterns of motion defined by the information to determine whether or not the person desires to enter or exit the access point 102. For example, if the information indicates that the person 116 is traveling in a direction 124, 136 or 138 towards the access point 102 during a first period of time and then travels in a direction 126, 136 or 138 away from the access point 102 during an immediately following second period of time, then a determination is made that the person does not want to gain access to the restricted area, but is simply passing by the access point. In contrast, if the information indicates that the person 116 is traveling at a first speed in a direction 124, 136 or 138 towards the access point 102 during a first period of time and then slows down as (s)he approaches the access point, a determination is made that the person does want to gain access to the restricted area. Similarly, if the information indicates that the person 116 is traveling at a first speed in a direction 124, 136 or 138 towards the access point 102 during a first period of time and stops upon reaching the access point, a determination is made that the person does want to gain access to the restricted area.

Upon determining that the person does not want to enter or exit the restricted area, the DPS 112 simply logs the unique identifier, the directionality information, the motion direction information, the speed/velocity information, and/or the results of the information analysis in a data store (not shown in FIG. 1) for later use. Upon determining that the person does want to enter the restricted area, the DPS 112 compares the unique identifier 210 to a plurality of unique identifiers stored in the data store to check whether the person is authorized to enter the restricted area. If the person is authorized to enter the restricted area, the DPS 112 causes a request for identification and location information to be sent to a PCD 150 in the person's possession.

In response to the request, the PCD 150 performs operations to determine its current location within a surrounding environment. In some scenarios, an RSSI based technique is used to determine the PCD's current location. The RSSI based technique involves using the PCD's Wi-Fi radio to survey all the available networks' MAC addresses within range. After collecting all the available networks' MAC addresses and the RSSI levels, the PCD 150 relays the MAC address and RSSI information back to a cloud 154 via wireless communication link 152. The cloud 154 then estimates the location of the PCD 150 based on the MAC addresses, RSSI levels, and known locations of each of the devices associated with the MAC addresses. A learning algorithm may be used to correlate between the two types of listed information.

In the case that the estimated location of the PCD 150 is within a certain radius from the original monitored door, the cloud 154 relays an open command to the door so as to cause a door opening actuator 128 to be actuated (e.g., for unlocking a lock). In order to reduce the delay between scanning a WAS and a door opening, the PCD 150 continually surveys Wi-Fi networks and has survey data ready for when a request is received thereat.

The cloud 154 and/or DPS 112 also log results of the information analysis and/or information specifying that access to the restricted area was provided to the person at a particular time. Upon determining that the person wants to exit the restricted area, the DPS 112 causes a door opening actuator 128 to be actuated, and also logs results of the information analysis and/or information specifying that the person exited the restricted area at a particular time.

The data logging allows the cloud 154 and/or DPS 112 to track the access points through which the person enters and exits, and the time of such entering and exiting. This historical information is useful for a variety of reasons. For example, the historical information can be used to determine when employees arrive at and/or leave work, whereby the need for conventional employee time-attendance systems requiring each employee to manually clock-in upon arrival at work and clock-out upon leaving work is no longer necessary. The historical information can also be used to identify individuals who gained access to a restricted area when a possible theft occurred or when equipment was removed from the restricted area.

Notably, the above described access control system overcomes certain drawbacks of conventional access control systems. For example, in the present invention, authorized individuals do not need to take any manual actions (e.g., swiping a card) to gain access to restricted areas. In effect, the need for certain access control equipment (e.g., card readers) has been eliminated, thereby reducing the overall cost of implementing the present access control system 100.

In other scenarios, the WAS 114 operates in both an energy harvesting mode and a communications mode. In the energy harvesting mode, the energy harvesting circuit 220 collects energy every time WAS 114 passes by an access point. The collected energy is stored in the energy storage device 222 (e.g., a capacitor). Once the energy storage device 222 is charged to an operating voltage level of the SRC device 212, the mode of the WAS 114 is changed from the energy harvesting mode to the communications mode. Thereafter, an SRC identifier signal is sent to the reader 104 via antenna 202 at the access point 102. The SRC identifier signal comprises the unique identifier 210. Information 214 indicating the rate of change of the charging voltage of the energy storage device 222 (e.g., a capacitor) may also be sent from the WAS 114 to the reader 104 via the SRC identifier signal. The rate of change information 214 specifies directionality of the WAS 114. At a later time, the reader 104 communicates the unique identifier 210 and/or rate of change information 214 to the DPS 112.

Notably, the motion sensors 120, 122 are also employed along with the multi-mode WAS 114 (i.e., the WAS configured to operate in both an energy harvesting mode and a communications mode). The motion sensors 120, 122 are used to determine the direction and/or speed/velocity of travel of the person 116 in proximity to the access point 102. Information specifying the person's direction and/or speed/velocity of travel is provided from the motion sensors 120, 122 to the reader 104.

At the DPS 112, a determination is made as to whether the person is authorized to access the restricted area based on the unique identifier 210 and/or whether the person is attempting to enter or exit the restricted area based on the rate of change information 214. If the person is attempting to enter the restricted area and is not authorized to access the restricted area, then the DPS 112 simply logs information indicating that the person was in proximity of the access point at a particular time. In contrast, if the person is attempting to enter the restricted area and is authorized to access the restricted area, then the DPS 112 causes a request for identification and location information to be sent to a PCD 150 in the person's possession.

In response to the request, the PCD 150 performs operations to determine its current location within a surrounding environment. In some scenarios, an RSSI based technique is used to determine the PCD's current location. The RSSI based technique involves using the PCD's Wi-Fi radio to survey all the available networks' MAC addresses within range. After collecting all the available networks' MAC addresses and the RSSI levels, the PCD 150 relays the MAC address and RSSI information back to a cloud 154 via wireless communication link 152. The cloud 154 then estimates the location of the PCD 150 based on the MAC addresses, RSSI levels, and known locations of each of the devices associated with the MAC addresses. A learning algorithm may be used to correlate between the two types of listed information.

In the case that the estimated location of the PCD 150 is within a certain radius from the original monitored door, the cloud 154 relays an open command to the door so as to cause a door opening actuator 128 to be actuated (e.g., for unlocking a lock). In order to reduce the delay between scanning a WAS and a door opening, the PCD 150 continually surveys Wi-Fi networks and has survey data ready for when a request is received thereat. The cloud 154 and/or DPS 112 also logs information specifying that access to the restricted area was provided to the person at a particular time.

In this scenario, the reader 104 is simply an edge connect module that controls the door opening actuator. As a result, the need for an interrogation reader (e.g., an RFID reader) is eliminated, thereby reducing the overall cost required to implement system 100.

Figure 3A:
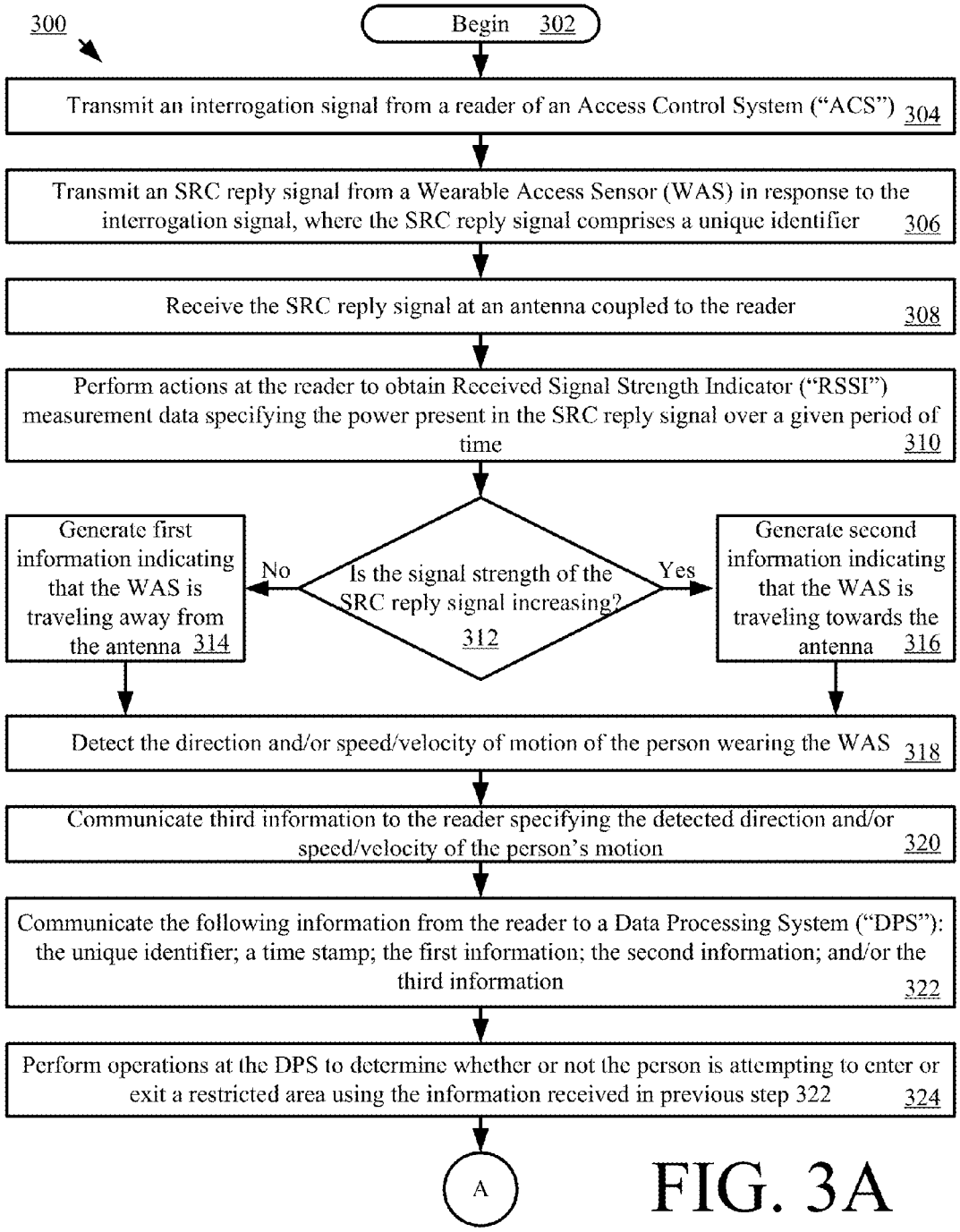
FIGS. 3A-3B (collectively referred to as "FIG. 3") provide a flow diagram of an exemplary method for controlling access to a restricted area.
Figure 3B:
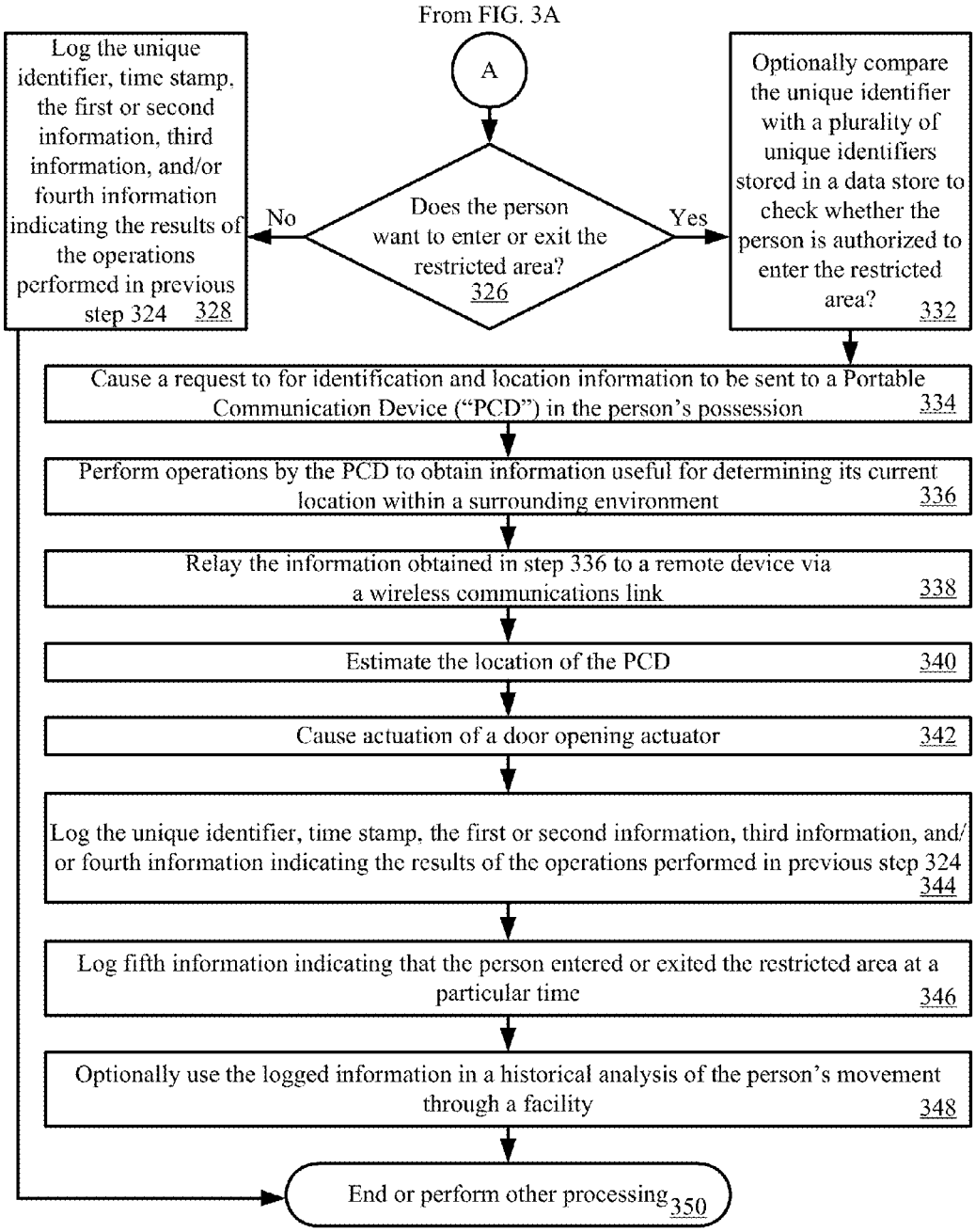

Referring now to FIGS. 3A-3B, there is provided a flow diagram of an exemplary method 300 for controlling access to a restricted area. As shown in FIG. 3A, method 300 begins with step 302 and continues with step 304 where an interrogation signal is transmitted from a reader (e.g., reader 104 of FIG. 1) of an ACS (e.g., ACS 100 of FIG. 1). In response to the interrogation signal, an SRC reply signal is transmitted from a WAS (e.g., WAS 114 of FIG. 1), as shown by step 306. The SRC reply signal comprises a unique identifier (e.g., unique identifier 210 of FIG. 2). In next step 308, the SRC reply signal is received at an antenna (e.g., antenna 106 or 108 of FIG. 1) coupled to the reader.

At the reader, actions are performed to obtain RSSI measurement data specifying the power present in the SRC reply signal over a given period of time, as shown by step 310. The RSSI measurement data is used by the reader to determine if the signal strength of the SRC reply message is increasing. Notably, this determination can alternatively be performed by a DPS (e.g., DPS 112 of FIG. 1). In this case, method 300 can be amended accordingly. Such changes are understood by persons skilled in the art.

If the signal strength of the SRC reply signal is decreasing [312:NO], then step 314 is performed where first information is generated indicating that the WAS is traveling away from the antenna. In contrast, if the signal strength of the SRC reply signal is increasing [312:YES], then step 316 is performed where second information is generated indicating that the WAS is traveling towards the antenna.

Upon completing step 314 or 316, the method 300 continues with step 318. Step 318 involves detecting the direction and/or speed/velocity of motion of the person (e.g., person 116 of FIG. 1) wearing the WAS. One or more motion sensors (e.g., sensors 120 and/or 122 of FIG. 1) can be used in step 318 for said detection. Thereafter in step 320, third information is communicated to the reader specifying the detected direction and/or speed/velocity of the person's motion. The reader then communicates the following information to the DPS: the unique identifier; a time stamp; the first information; the second information; and/or the third information, as shown by step 322.

At the DPS, operations are performed in step 324 to determine whether or not the person is attempting to enter or exit the restricted area using the information received in previous step 322. For example, if the received information indicates that the WAS is traveling towards an entrance antenna (e.g., antenna 108 of FIG. 1) and the person is moving in a first direction (e.g., direction 124 of FIG. 1), then a determination is made that the person desires to enter the restricted area via an access point (e.g., access point 102 of FIG. 1). In contrast, if the received information indicates that the WAS is traveling towards an exit antenna (e.g., antenna 106 of FIG. 1) and the person is moving in a direction opposite the first direction (e.g., direction 126 of FIG. 1), then a determination is made that the person desires to exit the restricted area via the access point. If the received information indicates that the WAS is traveling away from the entrance antenna, then a determination is made that the person is not trying to enter the restricted area. Similarly, if the received information indicates that the WAS is traveling away from the exit antenna, then a determination is made that the person is not trying to exit the restricted area. The present invention is not limited to the particulars of these examples. In this regard, it should be understood that the DPS additionally or alternatively analyzes patterns of motion defined by the received information to determine whether or not the person desires to enter or exit the access point.

After completing step 324, method 300 continues with decision step 326 of FIG. 3B. If it is determined that the person does not want to enter or exit the restricted area [326: NO], then step 328 is performed where the following information is logged in a data store: the unique identifier; a time stamp; the first or second information; the third information; and/or the fourth information indicating the results of the operations performed in previous step 324. Subsequently, step 350 is performed where method 300 ends or other processing is performed.

If it is determined that the person does want to enter or exit the restricted area [326:YES], then optional step 332 is performed. Optional step 332 is performed when the person is attempting to enter the restricted area, and therefore involves comparing the unique identifier with a plurality of unique identifiers stored in a data store to check whether the person is authorized to enter the restricted area. When a person is attempting to exit the restricted area or an authorized person is attempting to enter the restricted area, the DPS causes a request for identification and location information to be sent to a PCD (e.g., PCD 150 of FIG. 1) in the person's possession, as shown by step 334.

In response to the request, the PCD performs operations in step 336 to obtain information useful for determining its current location within a surrounding environment. In some scenarios, an RSSI based technique is used to determine the PCD's current location. The RSSI based technique involves using the PCD's Wi-Fi radio to survey all the available networks' MAC addresses within range. After collecting all the available networks' MAC addresses and the RSSI levels, the PCD relays the MAC address and RSSI information back to a cloud (e.g., cloud 154 of FIG. 1) via wireless communication link (e.g., wireless communication link 152 of FIG. 1), as shown by step 338. The cloud then performs operations in step 340 to estimate the location of the PCD. The location estimate can be determined based on the MAC addresses, RSSI levels, and known locations of each of the devices associated with the MAC addresses. A learning algorithm may be used to correlate between the two types of listed information.

In the case that the estimated location of the PCD is within a certain radius from the original monitored door, the cloud relays an open command to the door so as to cause a door opening actuator (e.g., actuator 128 of FIG. 1) to be actuated (e.g., for unlocking a lock), as shown by step 342. Upon completing step 342, steps 344-346 are performed to log the following information: the unique identifier; the time stamp; the first or second information; the third information; the fourth information; and/or fifth information indicating that the person entered or exited the restricted area at a particular time. The logged information can optionally be used in step 348 to perform a historical analysis of the person's movement through a facility. Thereafter, step 350 is performed where method 300 ends or other processing is performed.

Figure 4A:
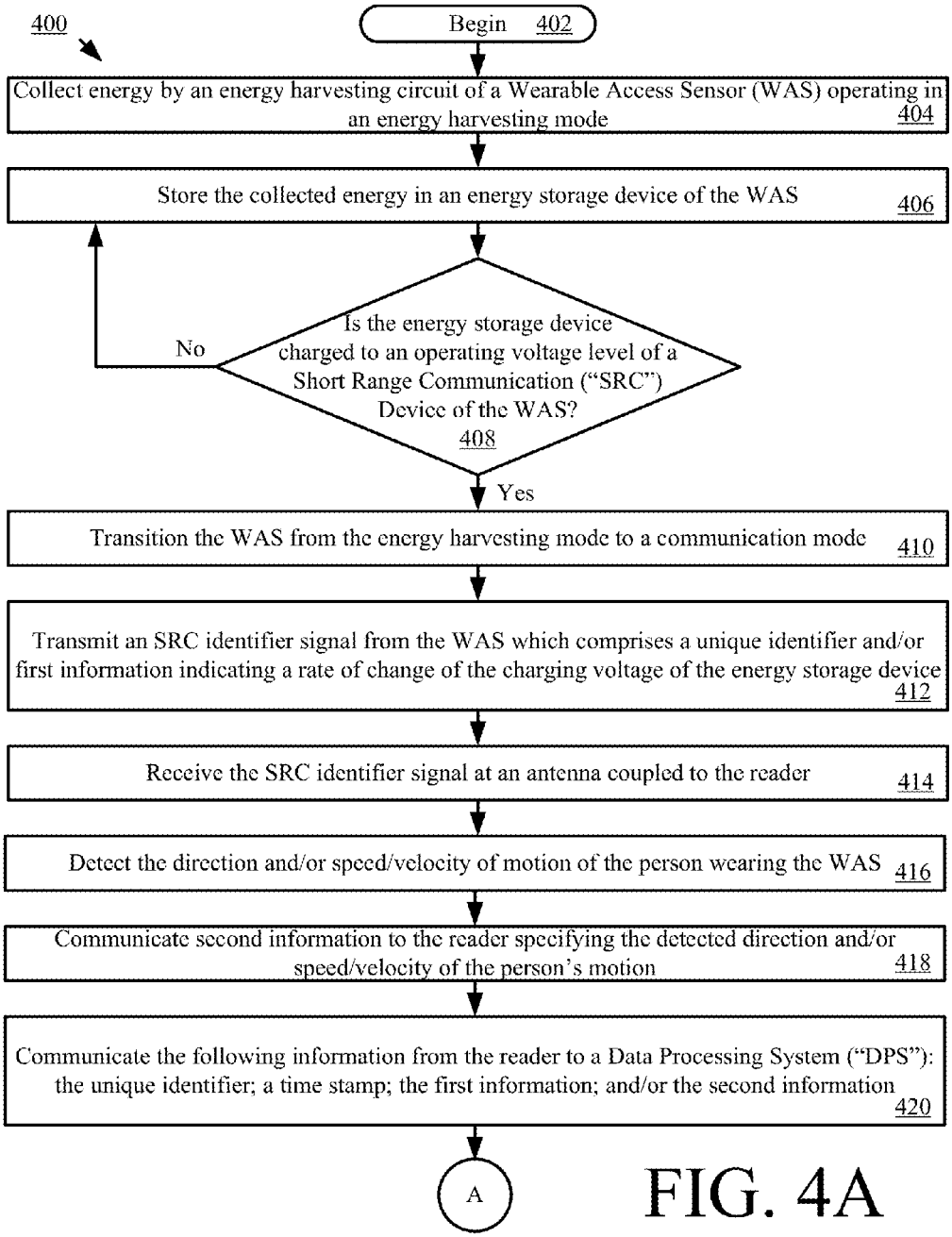

Referring now to FIGS. 4A-4B, there is provided a flow diagram of another exemplary method 400 for controlling access to a restricted area. As shown in FIG. 4A, method 400 begins with step 402 and continues with step 404 where an energy harvesting circuit (e.g., circuit 220 of FIG. 2) of a WAS (e.g., WAS 114 of FIG. 1) collects energy. The collected energy is then stored in an energy storage device (e.g., device 222 of FIG. 2) of the WAS. When the energy storage device charges to an operating voltage level of an SRC device (e.g., SRC device 212 of FIG. 2) of the WAS [408:YES], step 410 is performed where the WAS is transitioned from its energy harvesting mode to its communication mode. In its communication mode, step 412 is performed. Step 412 involves transmitting an SRC identifier signal from the WAS. The SRC identifier signal comprises a unique identifier and/or first information indicating a rate of change of the charging voltage of the energy storage device. The SRC identifier signal is then received in step 414 at an antenna (e.g., antenna 106 or 108 of FIG. 1) coupled to the reader.

In a next step 416, the direction and/or speed/velocity of motion of the person wearing the WAS is detected. One or more motion sensors (e.g., sensors 120 and/or 122 of FIG. 1) can be used in step 416 for said detection. Thereafter in step 418, second information is communicated to the reader specifying the detected direction and/or speed/velocity of the person's motion. The reader then communicates the following information to the DPS: the unique identifier; a time stamp; the first information; and/or the second information, as shown by step 420. After completing step 420, method 400 continues with step 422 of FIG. 4B.

At the DPS, operations are performed in step 422 to determine whether or not the person is attempting to enter or exit the restricted area using the information received in previous step 420. For example, if the received information indicates that the WAS is traveling towards an entrance antenna (e.g., antenna 108 of FIG. 1) and the person is moving in a first direction (e.g., direction 124 of FIG. 1), then a determination is made that the person desires to enter the restricted area via an access point (e.g., access point 102 of FIG. 1). In contrast, if the received information indicates that the WAS is traveling towards an exit antenna (e.g., antenna 106 of FIG. 1) and the person is moving in a direction opposite the first direction (e.g., direction 126 of FIG. 1), then a determination is made that the person desires to exit the restricted area via the access point. If the received information indicates that the WAS is traveling away from the entrance antenna, then a determination is made that the person is not trying to enter the restricted area. Similarly, if the received information indicates that the WAS is traveling away from the exit antenna, then a determination is made that the person is not trying to exit the restricted area. The present invention is not limited to the particulars of these examples. In this regard, it should be understood that the DPS additionally or alternatively analyzes patterns of motion defined by the received information to determine whether or not the person desires to enter or exit the access point.

After completing step 422, method 400 continues with decision step 424 of FIG. 4B. If it is determined that the person does not want to enter or exit the restricted area [424: NO], then step 426 is performed where the following information is logged in a data store: the unique identifier; a time stamp; the first information; the second information; and/or the third information indicating the results of the operations performed in previous step 422. Subsequently, step 444 is performed where method 400 ends or other processing is performed.

If it is determined that the person does want to enter or exit the restricted area [424:YES], then optional step 427 is performed. Optional step 427 is performed when the person is attempting to enter the restricted area, and therefore involves comparing the unique identifier with a plurality of unique identifiers stored in a data store to check whether the person is authorized to enter the restricted area. When a person is attempting to exit the restricted area or an authorized person is attempting to enter the restricted area, the DPS causes a request for identification and location information to be sent to a PCD (e.g., PCD 150 of FIG. 1) in the person's possession, as shown by step 428.

In response to the request, the PCD performs operations in step 430 to obtain information useful for determining its current location within a surrounding environment. In some scenarios, an RSSI based technique is used to determine the PCD's current location. The RSSI based technique involves using the PCD's Wi-Fi radio to survey all the available networks' MAC addresses within range. After collecting all the available networks' MAC addresses and the RSSI levels, the PCD relays the MAC address and RSSI information back to a cloud (e.g., cloud 154 of FIG. 1) via wireless communication link (e.g., wireless communication link 152 of FIG. 1), as shown by step 432. The cloud then performs operations in step 434 to estimate the location of the PCD. The location estimate can be determined based on the MAC addresses, RSSI levels, and known locations of each of the devices associated with the MAC addresses. A learning algorithm may be used to correlate between the two types of listed information.

In the case that the estimated location of the PCD is within a certain radius from the original monitored door, the cloud relays an open command to the door so as to cause a door opening actuator (e.g., actuator 128 of FIG. 1) to be actuated (e.g., for unlocking a lock), as shown by step 434. Upon completing step 434, steps 436-440 are performed to log the following information: the unique identifier; the time stamp; the first information; the second information; the third information; and/or the fourth information indicating that the person entered or exited the restricted area at a particular time. The logged information can optionally be used in step 442 to perform a historical analysis of the person's movement through a facility. Thereafter, step 444 is performed where method 400 ends or other processing is performed.

Additionally, in some scenarios, the WAS may detect no rate of change when the wearer is standing near the access point of a restricted area. For example, let's assume that a person travels towards the access point whereby the WAS detects a rate of change of the energy collected by the energy harvesting circuit thereof. When the person arrives at the access point, (s)he is stopped by another person for a discussion. At this time, the WAS detects no rate of change of the energy collected by the energy harvesting circuit thereof. In response to such a detection, the WAS communicates a signal to the reader (e.g., reader 104 of FIG. 1) indicating that there is currently no change in the rate at which the energy harvesting circuit is collecting energy. In turn, the reader performs operations to cause termination of the emission of an electromagnetic field from the entrance antenna (e.g., antenna 108 of FIG. 1). The electromagnetic field is once again emitted upon the expiration of a pre-defined period of time (e.g., 2 minutes). In this way, the person may still obtain access to the restricted area after finishing said discussion with the other person.

The following discussion explains an exemplary mathematical algorithm for estimating the location of a PCD within a building. For a high frequency transmitter and receiver antenna, the well-known Friis transmission equation is given below. This assumes free space environment and no polarization loss between the receive and transmit antennas nor absorption of signal from the PCD by a person holding it.

$$Pr = \frac{PtGtGrc^2}{(4\pi Rf)^2}$$

where Pr is the received power (PCD), Pt is the transmitter power (Wi Fi antenna), Gt is the transmitter antenna gain, Gr is the receiver gain, R is the vector between the transmit and receive antennas, f is the operating frequency, and c is the speed of light. Taking the LOG of both sides produces the following mathematical equation.

$$Pr = Pt + Gt + Gr + 20\text{LOG}\left(\frac{\lambda}{4\pi R}\right)$$

where Pr and Pt are in units of dBm, Gt and Gr are in units of dB, λ is in units of meters, and R is in units of meters.

Figure 6:
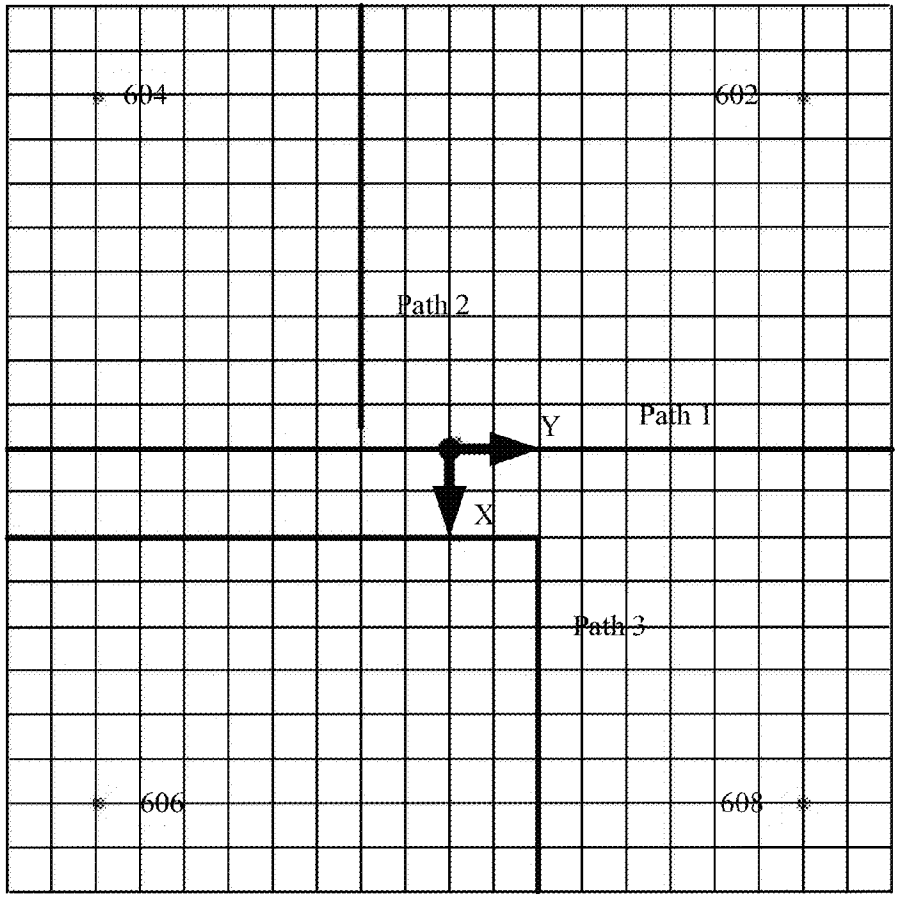
FIG. 6 is an illustration of a four antenna system with three defined paths.

FIG. 6 provides an illustration showing a symmetrical array of four (4) WiFi transmit antennas 602, 604, 606, 608. The transmit antennas 602-608 are mounted at the ceiling level (e.g., about 4 meters above the floor) of a building. The three paths 1, 2, 3 are also shown where a PCD (e.g., about 1 meter above the floor) moves. The PCD travels along path 1 which is symmetrical and paths 2, 3 which are not symmetrical. The coordinate system origin is shown in the center of the antennas.

In FIG. 6, the grid or step size is one (1) m. Each path is defined in one (1) m steps. The transmit antenna Pt is assumed to be twenty-eight (28) dBm, the transmit antenna gain Gt is five (5) dB, the receiver antenna gain Gr is negative two (−2) dB, and the frequency f is two point four (2.4) GHz.

FIG. 7 provides a graph showing the simulation results for symmetrical path 1 where the PCD travels down the centerline of the antenna system. As expected, a very symmetrical set of graphs meeting at the center where the PCD is directly in the middle of the antenna system. There is a mirror symmetry in the received power from the antenna pair 604/606 and antenna pair 602/608.

FIG. 8 provides a graph showing the simulation results for asymmetrical path 2. Path 2 starts off down the centerline, but cuts over at 8 m along the path between antenna 604 and antenna 602. Path 2 is closer by 2 m to antenna 604 than antenna 602. At the $8^{th}$ step where the PCD starts to break away from the centerline toward antenna 604 and antenna 602 (but 2 m closer to antenna 604), the signal is about 1 dBm higher after the next step. So a 2 m step along the breakaway point corresponds to a 2.5 dBm signal change between antennas 604 and 606.

FIG. 9 provides a graph showing the simulation results for asymmetrical path 3. Path 3 is another asymmetrical path where the PCD travels parallel to the centerline but 2 m closer to antenna 604 and then breaks away toward antennas 606, 608 (but 2 m closer to antenna 608).

Using simple linear interpolation of differences in the four antenna signals is the first consideration in estimating the location along a known path. The estimated position P(x,y) can be expressed by the following mathematical equation.

$$P(x,y)=C1(S_{Tx3}-S_{Tx2})a_x+C2(S_{Tx4}-S_{Tx1})a_x+C3(S_{Tx1}-S_{Tx2})a_y+C4(S_{Tx4}-S_{Tx3})a_y$$

where C1, C2, C3 and C4 are coefficients, the $S_{Tx1}$ to $S_{Tx4}$, are the signal strengths, and $a_x$ and $a_y$ are the x and y unit vectors. The above mathematical equation can be written in linear matrix form as shown below.

$$P(x,\ y) = \begin{bmatrix} C1(S_{Tx3} - S_{Tx2}) & C3(S_{Tx1} - S_{Tx2}) \\ C3(S_{Tx1} - S_{Tx2}) & C4(S_{Tx4} - S_{Tx3}) \end{bmatrix} \begin{bmatrix} a_x \\ a_y \end{bmatrix}$$

Using one or more of the paths to determine the coefficients and the simplification that C1=C2 and C3=C4, one can show that the predicted path P(x,y) can be accurate to less than one meter.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method for controlling access to a restricted area, comprising:

determining, by an electronic circuit, whether a person desires to enter the restricted area based on (1) a directionality of a Wearable Access Sensor ("WAS") being worn by a person, and (2) a direction and speed of the person's motion;

checking whether the person is authorized to enter the restricted area using a first unique identifier associated with the WAS;

causing the person's Portable Communication Device ("PCD") to transmit a second unique identifier and location information useful in determining the PCD's location within a surrounding environment, when a determination is made that the person is authorized to enter the restricted area;

using the second unique identifier and location information to confirm that the person is currently located at an access point of the restricted area; and causing actuation of a mechanical actuator to enable the person's entrance into the restricted area when it is determined that the person desires to enter the restricted area, the person is authorized to enter the restricted area, and the person is currently located at the access point of the restricted area.

2. The method according to claim 1, wherein a determination as to whether or not the person desires to enter the restricted area is made based on Received Signal Strength Indicator ("RSSI") measurement data specifying a power present in a signal received from a Wearable Access Sensor ("WAS") worn by the person.

3. The method according to claim 1, wherein the location information is obtained by the PCD using a Received Signal Strength Indicator ("RSSI") based technique.

4. The method according to claim 1, further comprising determining whether the PCD is within a certain radius from the access point of the restricted area.

5. The method according to claim 4, wherein the mechanical actuator is caused to actuate when it is determined that the PCD is within a certain radius from the access point of the restricted area.

6. The method according to claim 1, further comprising logging information indicating that the person entered the restriction area at a particular time, subsequent to causing actuation of the mechanical actuator.

7. A method for controlling access to a restricted area, comprising:

determining, by an electronic circuit, whether a person desires to enter the restricted area;

checking whether the person is authorized to enter the restricted area using a first unique identifier associated with a Wearable Access Sensor ("WAS") being worn by the person;

causing the person's Portable Communication Device ("PCD") to transmit a second unique identifier and location information useful in determining the PCD's location within a surrounding environment, when a determination is made that the person is authorized to enter the restricted area;

using the second unique identifier and location information to confirm that the person is currently located at an access point of the restricted area; and causing actuation of a mechanical actuator to enable the person's entrance into the restricted area when it is determined that the person desires to enter the restricted area, the person is authorized to enter the restricted area, and the person is currently located at the access point of the restricted area;

wherein a determination as to whether or not the person desires to enter the restricted area is made based on rate of change data specifying a rate of change of a charging voltage of an energy storage device used in an electromagnetic field energy harvesting circuit disposed within the WAS.

8. A method for controlling access to a restricted area, comprising:

determining, by an electronic circuit, whether a person desires to enter the restricted area;

checking whether the person is authorized to enter the restricted area using a first unique identifier associated with a Wearable Access Sensor ("WAS") being worn by the person;

causing the person's Portable Communication Device ("PCD") to transmit a second unique identifier and location information useful in determining the PCD's location within a surrounding environment, when a determination is made that the person is authorized to enter the restricted area;

using the second unique identifier and location information to confirm that the person is currently located at an access point of the restricted area; and causing actuation of a mechanical actuator to enable the person's entrance into the restricted area when it is determined that the person desires to enter the restricted area, the person is authorized to enter the restricted area, and the person is currently located at the access point of the restricted area;

wherein the location information is obtained by the PCD using a Received Signal Strength Indicator ("RSSI") based technique; and wherein the RSSI based technique comprises:

performing operations by the PCD to survey an available networks' Media Access Control ("MAC") addresses within range thereof; and collecting RSSI levels for signals received from devices associated with the available networks' MAC addresses.

9. The method according to claim 8, wherein the RSSI levels and known locations of the devices associated with the available networks' MAC addresses are used to confirm that the person is currently located at an access point of the restricted area.

10. A method for controlling access to a restricted area, comprising:

determining, by an electronic circuit, whether a person desires to enter the restricted area;

checking whether the person is authorized to enter the restricted area using a first unique identifier associated with a Wearable Access Sensor ("WAS") being worn by the person;

causing the person's Portable Communication Device ("PCD") to transmit a second unique identifier and location information useful in determining the PCD's location within a surrounding environment, when a determination is made that the person is authorized to enter the restricted area;

using the second unique identifier and location information to confirm that the person is currently located at an access point of the restricted area;

causing actuation of a mechanical actuator to enable the person's entrance into the restricted area when it is determined that the person desires to enter the restricted area, the person is authorized to enter the restricted area, and the person is currently located at the access point of the restricted area; and collecting energy by an energy harvesting circuit of the WAS from an electromagnetic field emitted from access control equipment disposed at an access point to one or more restricted areas.

11. A system, comprising:

a Wearable Access Sensor ("WAS") being worn by the person;

a Portable Communication Device ("PCD") in the person's possession;

at least one electronic circuit in communication with at least one of the WAS and the PCD, where the electronic circuit is configured to:

determine whether the person desires to enter the restricted area based on (1) a directionality of a Wearable Access Sensor ("WAS") being worn by a person, and (2) a direction and speed of the person's motion;

check whether the person is authorized to enter the restricted area using a first unique identifier associated with the WAS being worn by the person;

cause the PCD to transmit a second unique identifier and location information useful in determining the PCD's location within a surrounding environment, when a determination is made that the person is authorized to enter the restricted area;

use the second unique identifier and location information to confirm that the person is currently located at an access point of the restricted area; and a mechanical actuator that is actuated to enable the person's entrance into the restricted area when it is determined that the person desires to enter the restricted area, the person is authorized to enter the restricted area, and the person is currently located at the access point of the restricted area.

12. The system according to claim 11, wherein a determination as to whether or not the person desires to enter the restricted area is made based on Received Signal Strength Indicator ("RSSI") measurement data specifying a power present in a signal received from a Wearable Access Sensor ("WAS") worn by the person.

13. The system according to claim 11, wherein the location information is obtained by the PCD using a Received Signal Strength Indicator ("RSSI") based technique.

14. The system according to claim 11, wherein the electronic circuit is further configured to determine whether the PCD is within a certain radius from the access point of the restricted area.

15. The system according to claim 14, wherein the mechanical actuator is caused to actuate when it is determined that the PCD is within a certain radius from the access point of the restricted area.

16. The system according to claim 11, wherein the electronic circuit is further configured to log information indicating that the person entered the restriction area at a particular time, subsequent to causing actuation of the mechanical actuator.

17. A system, comprising:

a Wearable Access Sensor ("WAS") being worn by the person;

a Portable Communication Device ("PCD") in the person's possession;

at least one electronic circuit in communication with at least one of the WAS and the PCD, where the electronic circuit is configured to determine whether the person desires to enter the restricted area, check whether the person is authorized to enter the restricted area using a first unique identifier associated with the WAS being worn by the person;

cause the PCD to transmit a second unique identifier and location information useful in determining the PCD's location within a surrounding environment, when a determination is made that the person is authorized to enter the restricted area;

use the second unique identifier and location information to confirm that the person is currently located at an access point of the restricted area; and a mechanical actuator that is actuated to enable the person's entrance into the restricted area when it is determined that the person desires to enter the restricted area, the person is authorized to enter the restricted area, and the person is currently located at the access point of the restricted area;

wherein a determination as to whether or not the person desires to enter the restricted area is made based on rate of change data specifying a rate of change of a charging voltage of an energy storage device used in an electromagnetic field energy harvesting circuit disposed within the WAS.

18. A system, comprising:

a Wearable Access Sensor ("WAS") being worn by the person;

a Portable Communication Device ("PCD") in the person's possession;

at least one electronic circuit in communication with at least one of the WAS and the PCD, where the electronic circuit is configured to:

determine whether the person desires to enter the restricted area;

check whether the person is authorized to enter the restricted area using a first unique identifier associated with the WAS being worn by the person;

cause the PCD to transmit a second unique identifier and location information useful in determining the PCD's location within a surrounding environment, when a determination is made that the person is authorized to enter the restricted area;

use the second unique identifier and location information to confirm that the person is currently located at an access point of the restricted area; and a mechanical actuator that is actuated to enable the person's entrance into the restricted area when it is determined that the person desires to enter the restricted area, the person is authorized to enter the restricted area, and the person is currently located at the access point of the restricted area;

wherein the location information is obtained by the PCD using a Received Signal Strength Indicator ("RSSI") based technique; and wherein the RSSI based technique comprises:

performing operations by the PCD to survey an available networks' Media Access Control ("MAC") addresses within range thereof; and collecting RSSI levels for signals received from devices associated with the available networks' MAC addresses.

19. The system according to claim 18, wherein the RSSI levels and known locations of the devices associated with the available networks' MAC addresses are used to confirm that the person is currently located at an access point of the restricted area.

20. A system, comprising:

a Wearable Access Sensor ("WAS") being worn by the person;

a Portable Communication Device ("PCD") in the person's possession;

at least one electronic circuit in communication with at least one of the WAS and the PCD, where the electronic circuit is configured to determine whether the person desires to enter the restricted area, check whether the person is authorized to enter the restricted area using a first unique identifier associated with the WAS being worn by the person;

cause the PCD to transmit a second unique identifier and location information useful in determining the PCD's location within a surrounding environment, when a determination is made that the person is authorized to enter the restricted area;

use the second unique identifier and location information to confirm that the person is currently located at an access point of the restricted area; and a mechanical actuator that is actuated to enable the person's entrance into the restricted area when it is determined that the person desires to enter the restricted area, the person is authorized to enter the restricted area, and the person is currently located at the access point of the restricted area;

wherein the WAS comprises an energy harvesting circuit that collects energy from an electromagnetic field emitted from access control equipment disposed at an access point to one or more restricted areas.

* * * * *